US007025690B2

(12) United States Patent
Nam

(10) Patent No.: US 7,025,690 B2
(45) Date of Patent: Apr. 11, 2006

(54) GOLF CLUB WITH TRANSPARENT GRIP

(76) Inventor: Sang-Ki Nam, #51-10, Jangcheon-Dong, Jelloanam-Do, Suncheon-City (KR) 540-959

( * ) Notice: Subject to any disclaimer, the term of this patent is extended or adjusted under 35 U.S.C. 154(b) by 0 days.

(21) Appl. No.: 10/816,782

(22) Filed: Apr. 2, 2004

(65) Prior Publication Data

US 2005/0221909 A1 Oct. 6, 2005

(51) Int. Cl.
*A63B 53/14* (2006.01)

(52) U.S. Cl. ..... 473/300

(58) Field of Classification Search ..... 473/305, 473/349, 324, 300–303
See application file for complete search history.

(56) References Cited

U.S. PATENT DOCUMENTS

| | | | | |
|---|---|---|---|---|
| 3,413,243 | A * | 11/1968 | Griffin | 521/54 |
| 5,669,825 | A * | 9/1997 | Shira | 473/324 |
| 5,721,030 | A | 2/1998 | Okada | |
| 5,769,307 | A * | 6/1998 | Takeda | 228/112.1 |
| 5,885,170 | A | 3/1999 | Takeda | |
| 5,968,621 | A | 10/1999 | Okada | |
| 6,237,193 | B1 * | 5/2001 | Skerker et al. | 16/430 |
| 2003/0211900 | A1 * | 11/2003 | Novak et al. | 473/300 |
| 2004/0127644 | A1 * | 7/2004 | Jacob et al. | 525/98 |
| 2004/0177812 | A1 * | 9/2004 | Goto et al. | 118/725 |
| 2004/0266546 | A1 * | 12/2004 | Huang | 473/300 |

FOREIGN PATENT DOCUMENTS

| | | | |
|---|---|---|---|
| JP | 54-112760 | * | 9/1979 |
| JP | 2003-25075 | * | 1/2003 |
| KR | 2003-0049007 | * | 6/2003 |

* cited by examiner

*Primary Examiner*—Stephen Blau
(74) *Attorney, Agent, or Firm*—Darby & Darby

(57) ABSTRACT

A transparent grip of a golf club, wherein prints for public information like photos or pictures are incorporated in the grip and the content of the incorporated prints is observable from the outside. The grip is composed of a sheet layer of an elastomeric material to increase gripping and hitting senses and to alleviate shock by covering the entire or a part of the circumference of the shaft of the golf club, a coating film layer to protect the sheet layer and a transparent shell as an integrally molded body, which is transparent enough to make the sheet layer visible from the outside and which is formed with a cavity to receive the shaft. The sheet layer can keep the record of, for example, the address or name of the owner without the worry of blotting or staining. The sheet layer, made of an elastomeric material, the transparent thin coating film layer formed with a number of fine projections and the transparent shell made of special material, in combination, bring forth the effect of being soft and not slippery and provide assurance and a snug feeling when gripped. Particularly, the invention has the advantage that individuals can incorporate photographs, pictures or particular matters for various events or commemorations into the grips with ease and at reduced cost making this invention very practical.

6 Claims, 4 Drawing Sheets

GOLF CLUB WITH TRANSPARENT GRIP

FIELD OF THE INVENTION

The present invention relates to a golf club with a transparent grip, and particularly a golf club with a transparent grip wherein a sheet layer having pictures, characters and the like printed thereon is formed on the surface of a shaft to be coupled to a grip, a coating film layer is formed on the surface of the sheet layer, and subsequently a grip of transparent material is fitted on the surface of the shaft so processed, in order to ensure not only the protection of the sheet layer but also clear identification of the contents printed on the sheet layer from the outside.

FIELD OF THE INVENTION

Grips of golf clubs are mostly formed by laminating covering materials of synthetic resin or rubber, these materials being in the form of a slender and long strip or band, around the shafts in a spiral form to finite thickness, because the grips of golf clubs need be formed so as to be gripped comfortably by hands and to avoid slipperiness.

The grips formed in the method of laminating the covering materials as described above required a great deal of labor and in addition, frequently a surplus or lack of the covering materials provided in advance resulted due to various factors including winding force, winding positions or spacings and the like, even if the covering materials for winding had been made ready in suitable lengths. Therefore, lately there are marketed many formed products, which are manufactured so as to impart high grasping power, anti-slipperiness and excellent elasticity by integrally forming irregularities on the surface of the club grips Such club grips are the parts which are easily contaminated by the sweat on hands or so during the exercise and so they are formed via a step of wrapping the covering materials as described above. However, all such grips made by forming are generally opaque or otherwise in a dense color like black or purple.

Incidentally, the grip part out of a golf club is the part on which most visions are concentrated, so that the manufacturers carve in a raised or depressed manner, on the grips, the advertising characters or pictures showing the company logos or commodity names or so.

The manufacture of the such club grips on which the names of companies are integrally engraved needed a large cost. Therefore, this method could be suitably applied only in such a case as a manufacturing company conducted mass production at a time for company advertisement, but the method could not be employed individually. Thus, for example, when certain ordinary individuals or authorities intend to present or donate golf clubs to commemorate sports meetings or special events from time to time, they tried to express the meaning of the events by attaching the stickers with the prints of memorable graphics or characters on the external surface of club grips.

In this case, however, sweat from hands tends to stick to the grips during exercising to weaken the adhering force of the stickers to thereby peel off the latter and at the same time, the adhesive from the back sides of the stickers migrates to the golfers' hands, giving the golfers sticky and unpleasant feeling.

On the other hand, the conventional grips are made of rubber material with achromatic colors of the black, purple, gray or the like, and so they are not fitted for tight and stable grip by golfers, thus resulting in slipping or twisting at the moment of impact during play. As the result, the grips were either provided on their surface with grooves, projections, spines or so, or the grips were manufactured in admixture with threads or so in order to prevent the golf clubs from slipping out of the golfers' hands when they swing, by virtue of that surface roughness.

Nevertheless, the conventional grips so manufactured are apt to wear out easily due to the material characteristic and the resulting worn grips get so slippery that more frequent replacements of grips are required to improve golfing scores, which represents an economic loss.

SUMMARY OF THE INVENTION

The present inventor having been engaged in this field of industry for decades came to develop the inventive grip of a golf club based on the consideration that the external observation of a variety of prints incorporated in the interior of the grips of golf clubs would bring about not only an advertising effect for the manufacturing and sales companies, but also, in the particular case of added personal or memorable information, the effect of preventing loss of the clubs and ensuring long memory of specific events, so as to make the grips practically useful.

That is, the primary object of the present invention is to provide a golf club with a transparent grip of a novel construction, which grip, in spite of applying the basic construction of the ordinary golf club grips, due to their different details, can easily incorporate specific pictures or photographs in a simple method and render those pictures or photographs visible from the outside, through the full transparent construction of the grip itself, and which grip can be preserved semi-permanently without deterioration in quality.

Another object of the invention is to provide a golf club with a transparent grip, which grip is softly felt, good in gripping sense and easily gripped in prevention of slippage and which has excellent physical properties including anti-wear to thereby dispense with the need of frequent replacement, because the grip is made of the material with a high wear strength, high tensile strength and high elongation rate.

Another object of the invention is to provide a golf club with a transparent grip, which grip can enhance a gripping as well as hitting sense and can alleviate shock, by using an elastomer material as the sheet material to be inserted in the interior of the grip or forming fine projections on the surface of thin, transparent coating in the grip.

A still other object of the invention is to provide a golf club with a transparent grip, which grip can allow a golfer to have a fragrant and pleasant feeling and to enjoy playing golf by using a hygienic aseptic grip, by adding a perfume and/or antibiotic nano material to the transparent grip.

The above-described objects of the invention are achieved according to an aspect of the invention by a transparent grip of a golf club, including a grip formed to enclose the circumferential end of a golf club, wherein said grip comprises a sheet layer of an elastomeric material to increase the gripping and hitting senses and to alleviate the shock by covering the entire or a part of the circumference of the end of shaft, and a transparent layer or shell transparent enough to allow the light to permeate enough to make the sheet layer visible or identifiable from the outside, and said transparent shell is provided with a cavity to receive the shaft to thereby ensure a firm coupling.

Preferably the transparent grip of a golf club according to the invention further includes a coating film layer between the sheet layer and the transparent shell to protect the sheet layer.

Further, the coating film layer is preferably formed, on its surface, with a number of fine projections by pressing correspondingly the surface of the coating film layer.

The transparent shell of the golf club grip according to the invention is made of a material selected from the group consisting of polyurethane resin; synthetic rubber(EPDM) composed of the mixture of ethylene, propylene and non-conjugated diene; the synthetic rubber composed of EPDM added further with the styrene-butadiene-rubber, dioctylphthalate and natural rubber; or the ethylene-vinylacetate-copolymer(EVA).

Also, preferably the transparent shell in the transparent grip of a golf club according to the invention further includes a perfume and/or a antibiotic nano material.

The transparent layer or shell composing the grip according to the invention is made colorlessly or with a light-color and is made so as to be transparent to allow the light to fully permeate to thereby make the inside sheet layer visible from the outside. This layer is usually made from two types of polyurethane resin, i.e. the polyether type and polyester type, which are formed by the addition polymerization of diisocyanate with glycol, the ester exchange reaction of biscarbamic acid with glycol, the reaction of diamine with ethylene carbonate or bisurethane with diamine so on. Further, in practice, the above-described transparent shells are formed into the cylindrical bodies with cavities in an integral molding process including the injection molding one.

A golf shaft and a sheet layer as well as coating film layers, and a transparent shell are respectively connected mutually, by applying entirely or partly the ordinary sheet-formed double-side adhesive tapes or colorless transparent liquid adhesives. The commemorable photographs for various public events, or the logos or graphics of manufacturers and/or sales agencies, or the addresses or names of individuals are directly printed on the surface of the sheet layers, or otherwise the sheet layers having the above-described substance carrying prints on the front faces and adhesive on the back faces may be attached.

DETAILED DRAWINGS OF THE DRAWINGS

Preferred embodiments of the present inventions are described in detail below by referring to the accompanying drawings As shown in FIGS. 1 to 5, a grip G of a golf club with a transparent grip according to the invention is coupled with a transparent shell 40 such that the shaft 10 cannot be detached manually, wherein the shell 40 is formed with a cavity 400 of the size proper to receive the end part of the shaft 10.

Figure 1:
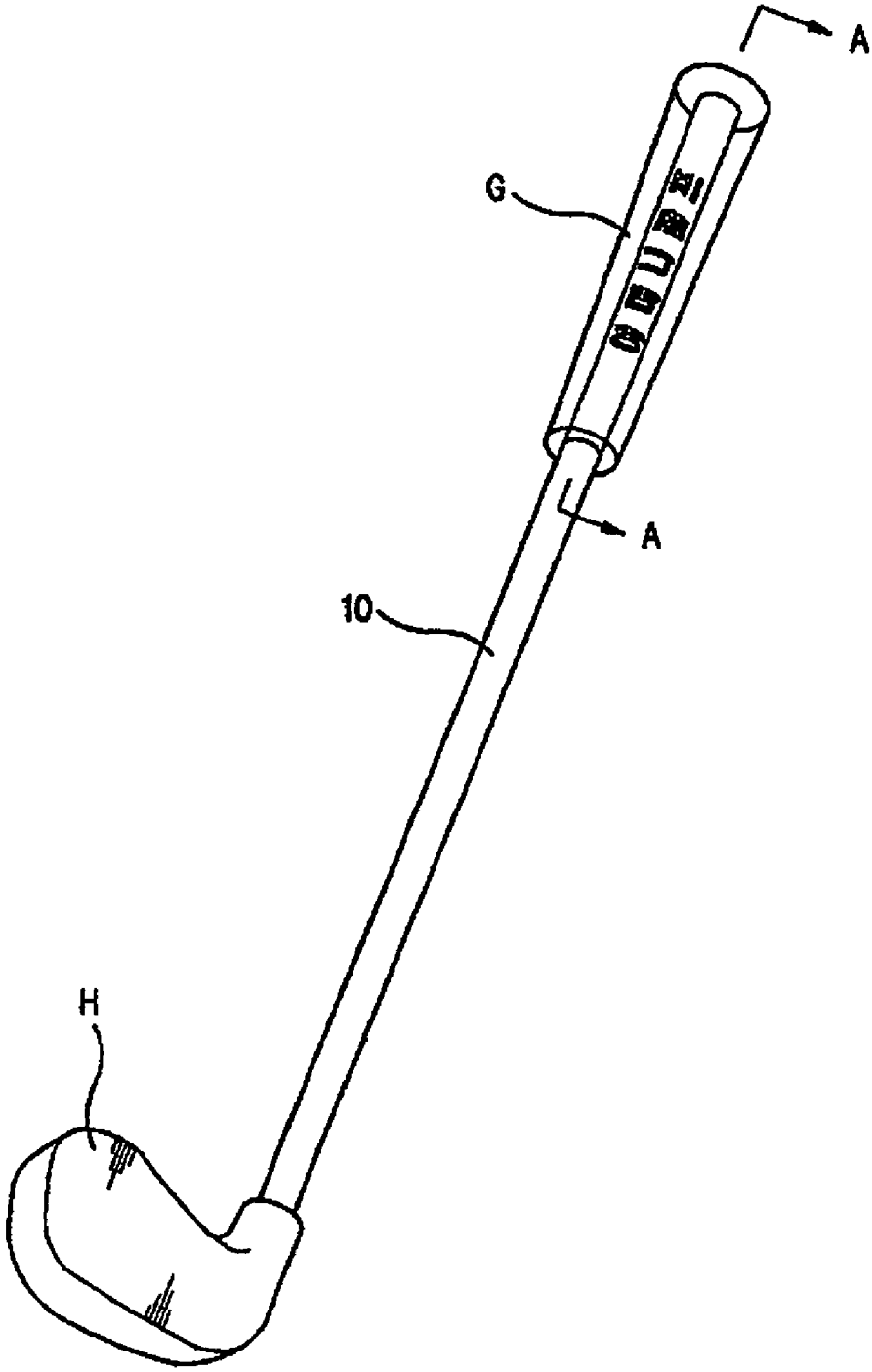
FIG. 1 shows the perspective view of an illustrative transparent grip of a golf club.
Figure 2:
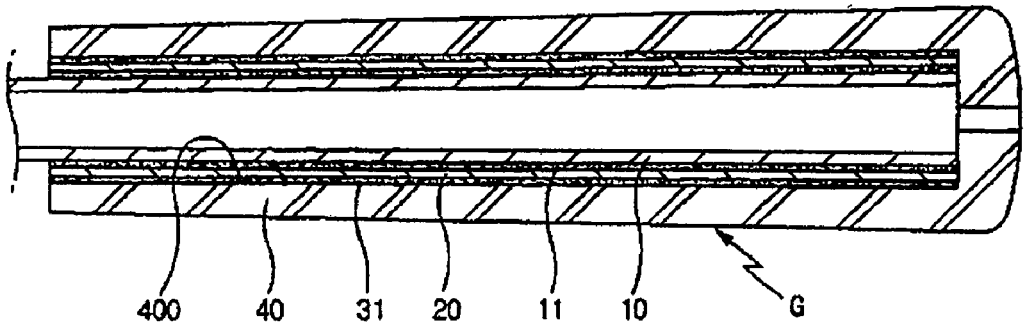
FIG. 2 shows the cross section taken along the line A—A of FIG. 1, illustrating a first embodiment of the transparent grip of a golf club according to the invention.

Now, a golf club with a transparent grip according to the first embodiment of the invention is described by referring to FIG. 2. The shaft 10 is positioned inside the grip G, while a sheet layer 20 is formed on the outer peripheral surface of the shaft 10. The sheet layer 20 is attached to the shaft 40 through an adhesive layer 11, wherein the adhesive layer 11 is formed as a sheet state adhesive like the double-sided adhesive tape or a coated liquid adhesive.

The above-described shaft 10, which is formed with the sheet layer 20 is inserted into the cavity 400 of the transparent shell 40 to couple with the latter through an adhesive layer 31. The adhesive used to couple the shaft 10 with the transparent shell 40 forms the adhesive layer 31 by means of a sheet adhesive like the double-sided adhesive tape or a coated liquid adhesive, wherein the adhesive layer 31 is formed by coating adhesive on the surface of the sheet layer 20 and/or on the inner peripheral surface of the transparent shell 40.

If the shaft 10 is inserted into the transparent shell 40 immediately after the formation of the adhesive layer 31, the shaft 10 would fail to reach the inner end of the cavity 400 and instead be stuck intermediately and hardened, due to the adhesive 31 formed on the surface of the sheet layer 20 or on the inner peripheral surface of the transparent shell 40. Accordingly, a high volatile solvent 50, such as a thinner or the like, is sprayed or coated on the adhesive layer 31 or on the inner peripheral surface of the transparent shell 40, before the shaft 10 is inserted into the cavity 400 of the transparent shell 40, so that the viscosity of the adhesive 31 may be temporarily lowered to help smoother insertion of the shaft 10. When an oil containing a rust preventing component, i.e. a rust preventive oil is used, instead of a volatile solvent, the rusting on a shaft is prevented and simultaneously the viscosity of the adhesive 31 is temporarily lowered, whereby the shaft can be easily inserted in the grip.

The shaft 10, which inserted smoothly or frictionlessly into the cavity 400 of the transparent shell 40 by virtue of the sprayed or coated solvent 50, gets fixed together with the sheet layer 20 on the transparent shell 40 after the adhesive layer 31 has been hardened with the evaporation of the solvent 50 following the predetermined elapsed time, whereby the shaft is secured firmly in position so as not to be changed in position or damaged under the shock from exercise.

The photographs or pictures indicating special events or tourist places, trade names or marks of manufacturers and/or sales agencies, or other public information or addresses or names showing particular persons, or the like can be directly printed or attached in the form of prints on the above-described sheet layers.

As the above-described sheet layers 20, paper can be used as usual. However, in order to increase the gripping sense when firmly holding the grip G and to increase the hitting sense transmitted to a user's hand when the head H of a golf club is hit onto a ball and at the same time to absorb the shock, the elastomeric materials including the vulcanized rubber, elastic fiber, damping foil and the like are used as the raw material for the sheet layer 20 in the present invention.

The use of the above elastomeric materials as the sheet layer 20 damps the shock transmitted to the grip G from the shaft 10 of a golf club after a swing, decreases the impact and damage to the player's hand and finally results in the improvement of the swinging sense as the expected effect.

Figure 3:
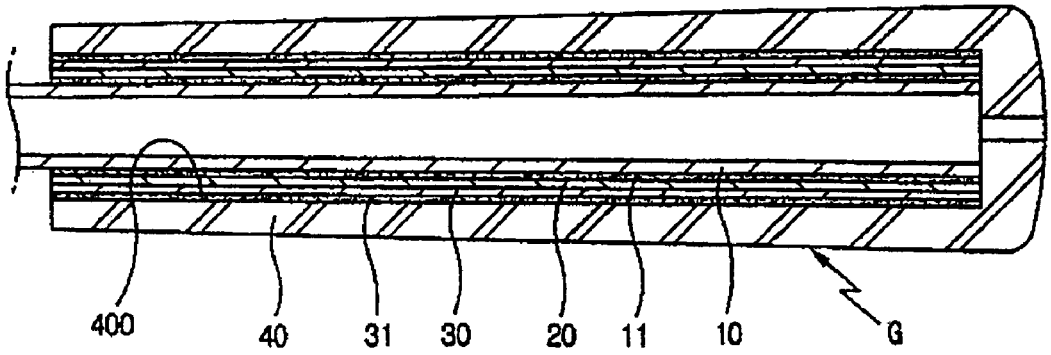
FIG. 3 shows the cross section taken along the line A—A of FIG. 1, illustrating a second embodiment of the transparent grip of a golf club according to the invention.

Referring to FIG. 3 which concerns the second embodiment of the present invention, an improved version of the first embodiment, a thin and transparent coating film layer 30 is formed on or covers the surface of the sheet layer 20, on which surface photographs, pictures, graphics, characters or so, are already printed or public information matter carrying prints are already attached, in order to protect the photographs or prints and the sheet layer 20. As described in connection with the first embodiment, a sheet layer 20 is formed on a shaft 10, then an adhesive layer 31 is formed on the surface of the sheet layer 20, and when the shaft 10 is inserted into the cavity 400 of a transparent shell 40, a thinner or volatile solvent is sprayed or coated onto the adhesive layer 31 to lower its viscosity. At that instant, the solvent may penetrate the sheet layer 20, thus the printed substance may blot or be stained, with the result that the advertising information may become obscure and the appearance may become bad-looking, or the adhesive may swell or cohere so as to leave traces or the residues of the adhesive 31 may be interposed to cause raised and depressed sites on the finally installed grip. This second embodiment is intended to resolve these problems with the first embodiment.

By forming a coating film layer 30 of plastics film on the printed surface of a sheet layer 20, the printed substance can be prevented from blotting or getting blurred, which would otherwise have been caused by the solvent sprayed or coated on the adhesive layer 31 before the insertion of the shaft 10 into the cavity 400 of the transparent shell 40. By this measure, the sheet layer 20 could additionally be obviated from being pushed along or torn due to the friction with the peripheral surface of the cavity 400. Furthermore, the above-described coating film layer 30 can easily slide into the cavity 400 for coupling with the transparent shell 40, because the surface of the coating film layer 30 is usually uniformly plain and smooth.

As described above, the coating film layer 30 intended for protecting the printed substance on the sheet layer 20 and for the beautiful gloss should be colorless or lightly colored and fully transparent so as to make the inner printed substance visible. As the raw material for this layer 30, polypropylene (P.P), polyvinylchloride(P.V.C), their laminated films etc., for example, may be used.

The formation of the coated film layer 30 is carried out by covering a thin synthetic resin film on the surface of the sheet layer 20, on which some public informations are printed or their prints are attached, heat-pressing the covering resin film by a heated rolling tool, or a proper adhesive can be attached on the surface of the sheet layer 20, or other various conventional coating methods may be applied. As described, although the coated film layer 30 can be directly formed on the sheet layer 20 attached on a shaft 10, alternatively the corresponding process step can be carried out by attaching, on the shaft 10, a sheet layer 20 having a coated film layer 30 formed beforehand, i.e. a combination of a sheet layer 20 with a coated film layer 30, so as to simplify the process.

Figure 5:
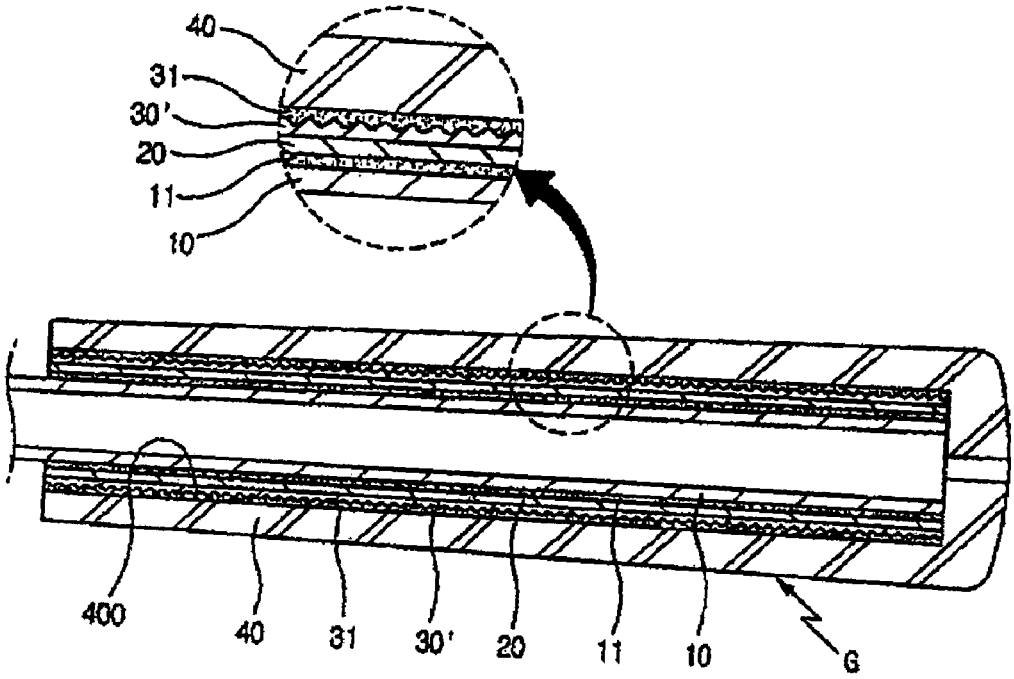
FIG. 5 shows the cross section taken along the line A—A of FIG. 1, illustrating a third embodiment of the transparent grip of a golf club according to the invention.

Referring to FIG. 5 concerning the third embodiment of the invention, the above-described coating film layer 30 in the second embodiment is formed on its surface with a number of fine projections to provide the grip-equipped golf club with an improved gripping sense and hitting sense. A number of fine projections formed on the surface of the coating film layer 30' by applying pressure thereon can give a further enhanced swinging sense together with the sheet layer 20 made of elastomeric substance. In addition, the coating film layer 30' formed with a number of fine projections on its surface is believed to have a positive effect on easy insertion into the cavity 400 to couple with the transparent shell 40 due to the reduced frictional surface compared with a plain surface.

Regarding to the assembling anew, after the shaft 10 is covered with a sheet layer 20 having a coating film layer 30 or 30' in the foregoing embodiments, the shaft is coupled with the transparent shell 40. As the raw material for the transparent shell 40, a transparent synthetic resin such as silicon resin, urethane resin, PVC composite material, rubber or the like is employed, wherein the resinous material is formed into a cylindrical body having a cavity 400 to receive a golf shaft in an integral-type forming process including an injection molding. As the raw material for the transparent shell 40, the polyurethane resin, the synthetic rubber (EPDM) composed of the mixture of ethylene, propylene and non-conjugated diene, the synthetic rubber(EPDM) composed of EPDM added further with styrene-butadiene-rubber, dioctylphthalate and natural rubber, or the ethylene-vinylacetate-copolymer(EVA), which has a proper elasticity and high frictional resistance to render a good feeling and non-slipperiness specially at the time of gripping, and furthermore enables a massive injection molding, may be preferably used.

The results of physical properties of the transparent bodies(I,II,III and IV) from the above-described 4 kinds of materials, usable for the golf club with the transparent grip according to the invention, as measured according to ASTM are summarized in the following table, wherein I symbolizes the polyurethane resin, II the synthetic rubber(EPDM), III the mixture of the synthetic rubber(EPDM) and styrene-butadiene-rubber, dioctylphthalate and natural rubber, and IV the ethylene-vinylacetate-copolymer(EVA).

TABLE 1

| □Test items | Unit | Testing methods | Specification | □ | □ | □ | □ |
|---|---|---|---|---|---|---|---|
| specific gravity | | ASTM D792 | 0.96 ± 0.03 | 0.95 | 0.96 | 0.97 | 0.95 |
| Hardness(5 sec) | Shore A | ASTM D2240 | 47 ± 3 | 45 | 47 | 48 | 46 |
| Tensile strength(Ultimate) | $kgf/cm^2$ | ASTM D412 | 25(min.) | 31 | 33 | 34 | 30 |
| Elongation (Ultimate) | % | ASTM D412 | 250(min.) | 280 | 300 | 330 | 290 |
| Modulus at 100% | $kgf/cm^2$ | ASTM D412 | 10(min.) | 12 | 14 | 15 | 13 |
| Tear strength | $kgf/cm^2$ | ASTM D624 | 10(min.) | 11 | 12 | 13 | 11 |
| Compression set (25□, 168 hr) | % | ASTM D3958 | — | 25 | 24 | 23 | 26 |

Further, the values of the friction modulus, hardness and tensile strength of the grips of tranparent bodies(I,II,III and IV) according to the invention, made of the above-described 4 kinds of materials, were measured, and their mean values and the corresponding values of the rubber grips used conventionally are compared in the following Table II.

TABLE 2

| Samples | Friction modulus (μ) | Hardness (Hs) | Tensile strength (MPa) |
|---|---|---|---|
| transparent grip according to the invention | 1.59 | 54 | 19.8 |
| ordinary rubber grip | 0.69 | 83 | 4.8 |

As can be understood from the above-described Tables 1 and 2, the transparent bodies 40 made of the inventive material is not easily worn or torn due to the high hardness, non-slippery and soft due to the live feeling and excellent recovery of gripping force and economical in manufacture due to the decreased production cost. In addition, in the case of the grip according to the invention, sweating doesn't occur on a golfer's hand and water doesn't penetrate the grip in rainy weather, so that the grip is neither swelled nor twisted to maintain the grip in its original form. As a result, a golfer can conduct a swing without wearing gloves to get the correct hitting feeling and experience a good transfer of force at the moment of impact.

Further, the transparent layer 40 is formed transparently to allow full transmission of light so as to exhibit the sheet layer 20 interposed inside it and may be colorless or lightly colored. The raw material used for the transparent layer 20 should usually be made more transparent and softer, when a more clear view of the printed matter on a transparent layer 20 is desired.

On the other hand, the addition of rosy perfume, mint flavor or the like or the antibacterial nano materials will give off a good smell when holding the grip G and help keep the grip clean, which is somewhat bacteria-friendly due to the contamination from the sweat and dust.

Figure 4:
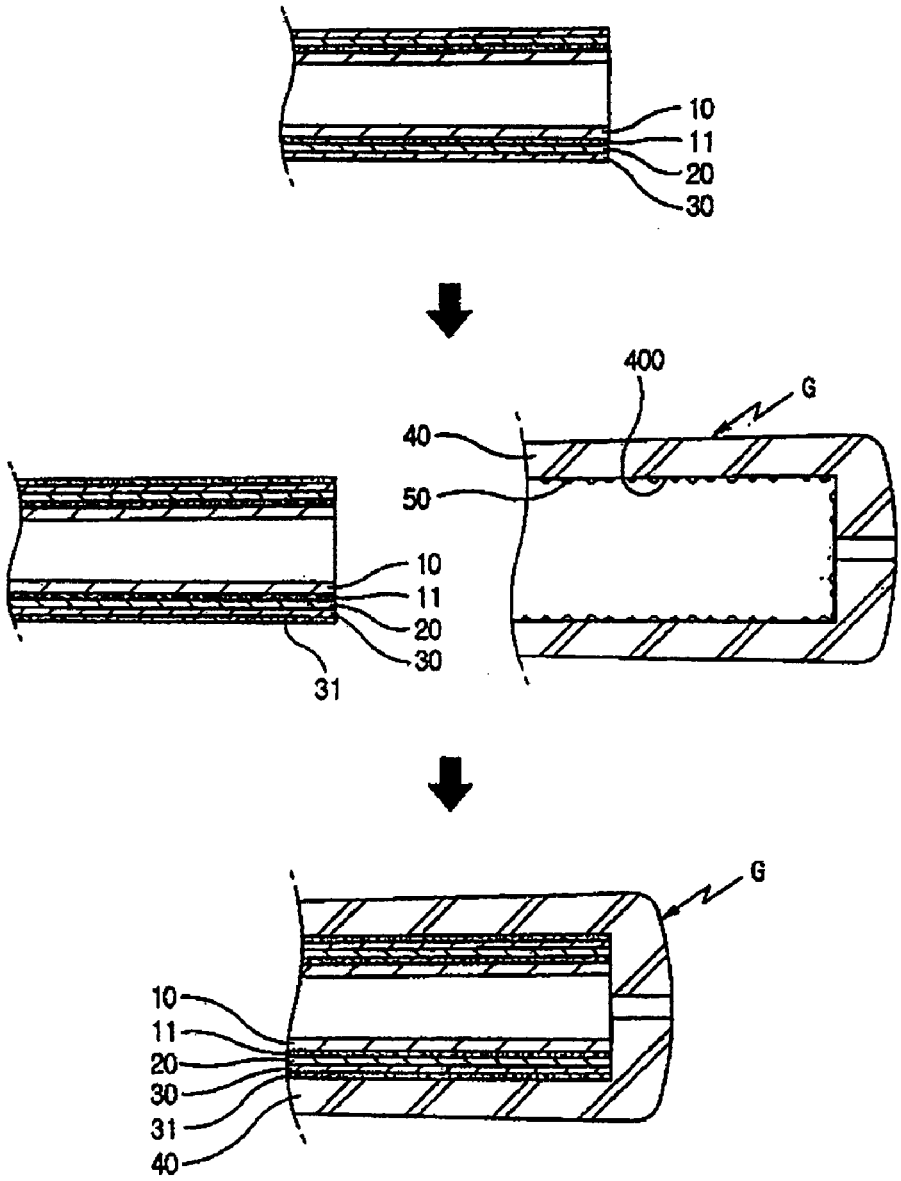
FIG. 4 shows the cross section illustrating the stepwise manufacturing process of the transparent grip of a golf club according to the invention.

The manufacturing process of the golf club having a transparent grip according to the invention, described as above, is summarized below with regard to FIG. 3 to FIG. 5. First, a shaft 10 is coated, on its circumferential end part, with adhesive 11, and a sheet layer 20, on which photographs, pictures, graphics or characters for public information are printed or prints carrying public information substances attached thereon. Then, a coating film layer 30, 30' is formed on the sheet layer 20 or a preformed coating film layer having sheet layer 20, prepared by coating a transparent thin resin film on a printed sheet surface previously, is attached on the shaft 10. On the coating film layer 30, 30', adhesive is sprayed, or a solid sheet-formed adhesive is laminated to yield an adhesive film layer 31. Subsequently, after a volatile solvent 50 is sprayed or coated on the adhesive film layer 31 and/or on the inner peripheral surface of the cavity 400 of a transparent shell 40, the shaft 10 is inserted into the cavity 400. After a predetermined time of drying, the above-described transparent shell 40 is strongly fixed around the shaft 10, together with the sheet layer 20 and the coating film layer 30,30'.

Accordingly, the golf club with the transparent grip according to the invention realizes the advantage that the solvent 50 is not absorbed in the sheet layer 20 due to the protective coating film layer 30 or 30' so as to exhibit the printed parts clearly without blotting or staining as well as to fully express the intended elegant sense, and specially, not only the gripping and hitting sense but also the shock damping effect, is improved due to the elastomeric material composing the sheet layer 20. In addition, the coating film layer 30 or 30' helps the smooth insertion of the transparent shell 40 due to its uniform and even surface to ensure the tight connection with the shell 40.

As described above, in the golf club with the transparent grip according to the invention, the external observation of a variety of prints incorporated in the interior of the grips of golf clubs can bring about not only the advertising effect of the manufacturing and sales companies, but also in the case of inclusion of personal or memorable information, the effect of preventing loss of the clubs and ensuring a long memory of specific events.

The golf club with the transparent grip according to the invention has the advantage that the construction is so easy as to allow easy manufacture at a reduced cost and specially individuals can incorporate the photographs, pictures or particular matters for various events or commemorations into the grips with ease and at reduced cost to make this invention very practical.

Further, the present invention has the advantage that the printed sheet is formed with the thin transparent coating film layer to deep the surface of the sheet layer free of spots or blots of printed substance and the sheet layer together with printed substances can be maintained in the original state almost permanently without deformation or twisting so that the quality of the products can be improved with the resultant excellent state of the sheet layers provided in the interior of the transparent grips.

Furthermore, the golf club with the transparent grip according to the invention is advantageous in that the grips are softly felt, good in a gripping sense and easily gripped to prevent slippage, and have excellent wear strength to dispense with the need for frequent replacement.

Further, the golf club with the transparent grip according to the invention is advantageous in that the grips can enhance a gripping as well as hitting sense and can alleviate. This is due to the sheet layers of elastomeric material, installed inside the grips, and the thin transparent coating film layer formed with a number of fine projections.

Still further, the golf club with the transparent grip according to the invention is advantageous in that the grips can allow golfers to have fragrant and pleasant feeling and to enjoy playing golf by using a hygienic aseptic grip.

What is claimed is:

1. A transparent grip of a golf club formed to enclose a circumferential end of a shaft of the golf club, wherein said grip comprises:

a sheet layer of an elastomeric material to increase the gripping and hitting sense and to alleviate shock by covering the entire or a part of the circumference of the shaft, a transparent layer or shell, said layer or shell being transparent enough to permeate the light so as to make the sheet layer visible or identifiable from the outside, and;

a coating film layer between the sheet layer and the transparent shell to protect the sheet layer, wherein a surface of the coating film layer includes a number of fine projections thereon.

2. The transparent grip of a golf club as defined in claim 1, wherein the transparent shell is made of at least one of the group consisting of polyurethane resin; synthetic rubber (EPDM) composed of the mixture of ethylene, propylene and non-conjugated diene; synthetic rubber composed of EPDM added further with styrene-butadiene-rubber, dioctylphthalate and natural rubber; or ethylene-vinylacetate-copolymer(EVA).

3. The transparent grip of a golf club as defined in claim 2, wherein the transparent shell further includes a perfume.

4. The transparent grip of a golf club as defined in claim 3, wherein the transparent shell further includes an antibiotic nano material.

5. The transparent grip of a golf club as defined in claim 1, wherein the transparent shell further includes a perfume.

6. The transparent grip of a golf club as defined in claim 1, wherein the transparent shell further includes an antibiotic nano material.

* * * * *